US007887291B2

(12) United States Patent
Chevrette et al.

(10) Patent No.: US 7,887,291 B2
(45) **Date of Patent: *Feb. 15, 2011**

(54) SUPPORT BAR WITH ADJUSTABLE SHIM DESIGN FOR TURBINE DIAPHRAGMS

(75) Inventors: Richard Chevrette, Troy, NY (US); John Powers, Scotia, NY (US); Dominick Werther, Schenectady, NY (US); Steven Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 808 days.

This patent is subject to a terminal disclaimer.

(21) Appl. No.: 11/803,640

(22) Filed: May 15, 2007

(65) Prior Publication Data

US 2008/0286097 A1 Nov. 20, 2008

(51) Int. Cl.
*F03B 11/02* (2006.01)

(52) U.S. Cl. ..... 415/209.2; 415/213.1

(58) Field of Classification Search ..... 415/126, 415/213.1, 209.2, 232

See application file for complete search history.

(56) References Cited

U.S. PATENT DOCUMENTS 1,352,278 A * 9/1920 Junggren ..... 415/135
2006/0251514 A1* 11/2006 Burdgick ..... 415/214.1

FOREIGN PATENT DOCUMENTS

JP 58106103 A * 6/1983
JP 01216004 A * 8/1989

OTHER PUBLICATIONS

Support Apparatus for a Steam Turbine Diaphragm. JP 01-216004 A Translation. Schreiber Translations, Inc. Feb. 2010. pp. 1-12.*

* cited by examiner

*Primary Examiner*—Richard Edgar
(74) *Attorney, Agent, or Firm*—Mark E. Henderson; Ernest G. Cusick; Frank A. Landgraff

(57) ABSTRACT

A support arrangement for a diaphragm segment in a turbine casing that includes: 1) a support bar joined to a diaphragm segment; 2) a turbine casing comprising a vertical wall and a horizontal shoulder, wherein a portion of the horizontal shoulder underlies the support bar; 3) a cut out area defined by the vertical wall and an outer edge of the support bar; and 4) a shim interposed between the horizontal shoulder and the support bar. The cut out area may be a size that allows the shim to pass through.

16 Claims, 5 Drawing Sheets

SUPPORT BAR WITH ADJUSTABLE SHIM DESIGN FOR TURBINE DIAPHRAGMS

TECHNICAL FIELD

This present application relates generally to power generating turbines. More specifically, but not by way of limitation, the present application relates to systems for to support arrangements for diaphragms within a turbine casing.

BACKGROUND OF THE INVENTION

A typical double-flow, low pressure (LP) steam turbine includes a pair of LP rotor sections surrounded, respectively, by diaphragms, each of which is comprised of a pair of semi-annular diaphragm ring segments that are joined at horizontal joints, spaced 180° from each other. Each ring segment supports a plurality of static nozzles that direct flow into the rotating buckets on axially spaced rotor wheels. The diaphragms are typically located axially between the rows of buckets and are typically supported vertically by any of several known methods. These include support bars, pins or support screws. Each design has its own advantages and disadvantages.

Support bars, for example, currently require that the diaphragm be installed before alignment. After the required measurements are recorded, the diaphragm and rotor are removed so the support bar can be machined to adjust the vertical position of the diaphragm. The sequence is then repeated as necessary to verify the diaphragm position. In addition, current diaphragm adjustment requires removal of both the diaphragm and the rotor as well as bolted-in shims, and can thus take several shifts or days to adjust.

Current support screw designs can only be used on the smaller HP stages because the weight of IP and LP stages is too great. Further, support pins, which are generally used in LP turbines, cannot support as much weight as support bar designs.

Accordingly, there remains a need for an easily accessible support arrangement that facilitates vertical adjustment of the diaphragm ring segment in a relatively quick and efficient manner.

BRIEF DESCRIPTION OF THE INVENTION

The present application thus describes a support arrangement for a diaphragm segment in a turbine casing that includes: 1) a support bar joined to a diaphragm segment; 2) a turbine casing comprising a vertical wall and a horizontal shoulder, wherein a portion of the horizontal shoulder underlies the support bar; 3) a cut out area defined by the vertical wall and an outer edge of the support bar; and 4) a shim interposed between the horizontal shoulder and the support bar. The cut out area may be a size that allows the shim to pass through.

The support bar may include a flange that engages an outwardly facing slot in the diaphragm segment. One or more bolts may extend through the flange and into the diaphragm segment.

The support arrangement may include means for retaining the shim between the horizontal shoulder and the support bar. In some embodiments, the means for retaining the shim between the horizontal shoulder and the support bar may include a shim retainment step in the horizontal shoulder. The shim retainment step may include a step that at least partially encloses the shim when the shim is positioned between the horizontal shoulder and the support bar. In other embodiments, the means for retaining the shim between the horizontal shoulder and the support bar comprises a back block positioned in the cutout area. The back block may abut the shim and the vertical wall of the turbine casing. The back block may be secured to the turbine casing by a bolt that passes through the back block into the horizontal shoulder. The height of the back block may be approximately the same as the height of the shim. In other embodiments, the height of the back block is approximately the same as the height of the support bar.

In some embodiments, the shim may include a removal hole. The support arrangement may further include a puller with a threaded insert that may engage the removal hole. In some embodiments, at least one of the sides of the shim may extend beyond an edge of the support bar, and the removal hole may be positioned within a portion of the shim that extends beyond the edge of the support bar.

The present application further describes a turbine, that includes: 1) a diaphragm that includes a lower diaphragm segment and an upper diaphragm segment that join at a horizontal split; 2) a support bar that attaches to the lower diaphragm segment; 3) a turbine casing that includes a vertical wall and a horizontal shoulder, wherein a portion of the horizontal shoulder underlies the support bar; 4) a cut out area defined by the vertical wall and an outer edge of the support bar; and 5) a shim interposed between the horizontal shoulder and the support bar. The cut out area comprises a size that allows the shim to pass through.

In some embodiments, at least one of the sides of the shim may extend beyond an edge of the support bar, the shim further comprises a removal hole that may be positioned within a portion of the shim that extends beyond the edge of the support bar. The turbine may further include a puller with a threaded insert that may engage the removal hole.

In some embodiments, the turbine may further include a shim retainment step in the horizontal shoulder. The shim retainment step may include a step that at least partially encloses the shim when the shim is positioned between the horizontal shoulder and the support bar. In other embodiments, the turbine may include a back block positioned in the cutout area such that the back block abuts the shim and the vertical wall of the turbine casing. The back block may be secured to the turbine casing by a bolt that passes through the back block into the horizontal shoulder.

In some embodiments, the support bar may include a flange that engages an outwardly facing slot in the lower diaphragm segment. These and other features of the present application will become apparent upon review of the following detailed description of the preferred embodiments when taken in conjunction with the drawings and the appended claims.

DETAILED DESCRIPTION OF THE INVENTION

Figure 1:
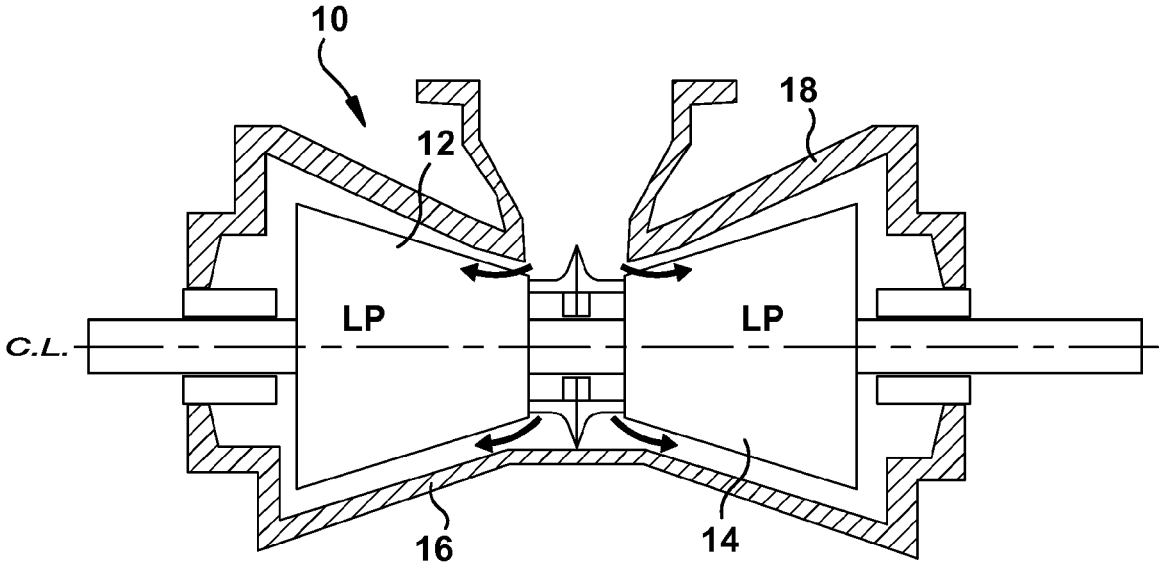
FIG. 1 (Prior Art)
FIG. 1 is a cross section, in partially schematic form, illustrating a conventional double flow, low pressure steam turbine.

Referring now to the figures, where the various numbers represent like parts throughout the several views, FIG. 1 illustrates a conventional double-flow, low pressure (LP) steam turbine 10 that includes first and second low pressure (LP) turbine sections 12, 14 surrounded by diaphragm assemblies 16, 18, respectively.

Figure 2:
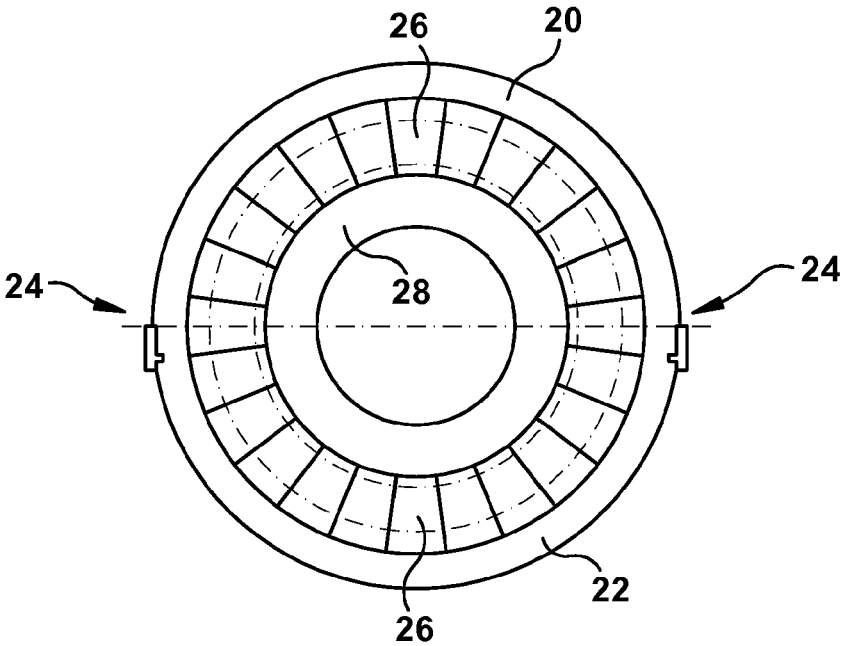
FIG. 2 (Prior Art)
FIG. 2 is a generally schematic end elevation of a pair of annular diaphragm ring segments joined at a horizontal split surface.

Each diaphragm is composed of a pair of semi-annular diaphragm ring segments 20, 22 (FIG. 2) joined at a horizontal split or joint surfaces 24. Each diaphragm segment supports a semi-annular row of nozzles 26 and an inner web 28.

Figure 3:
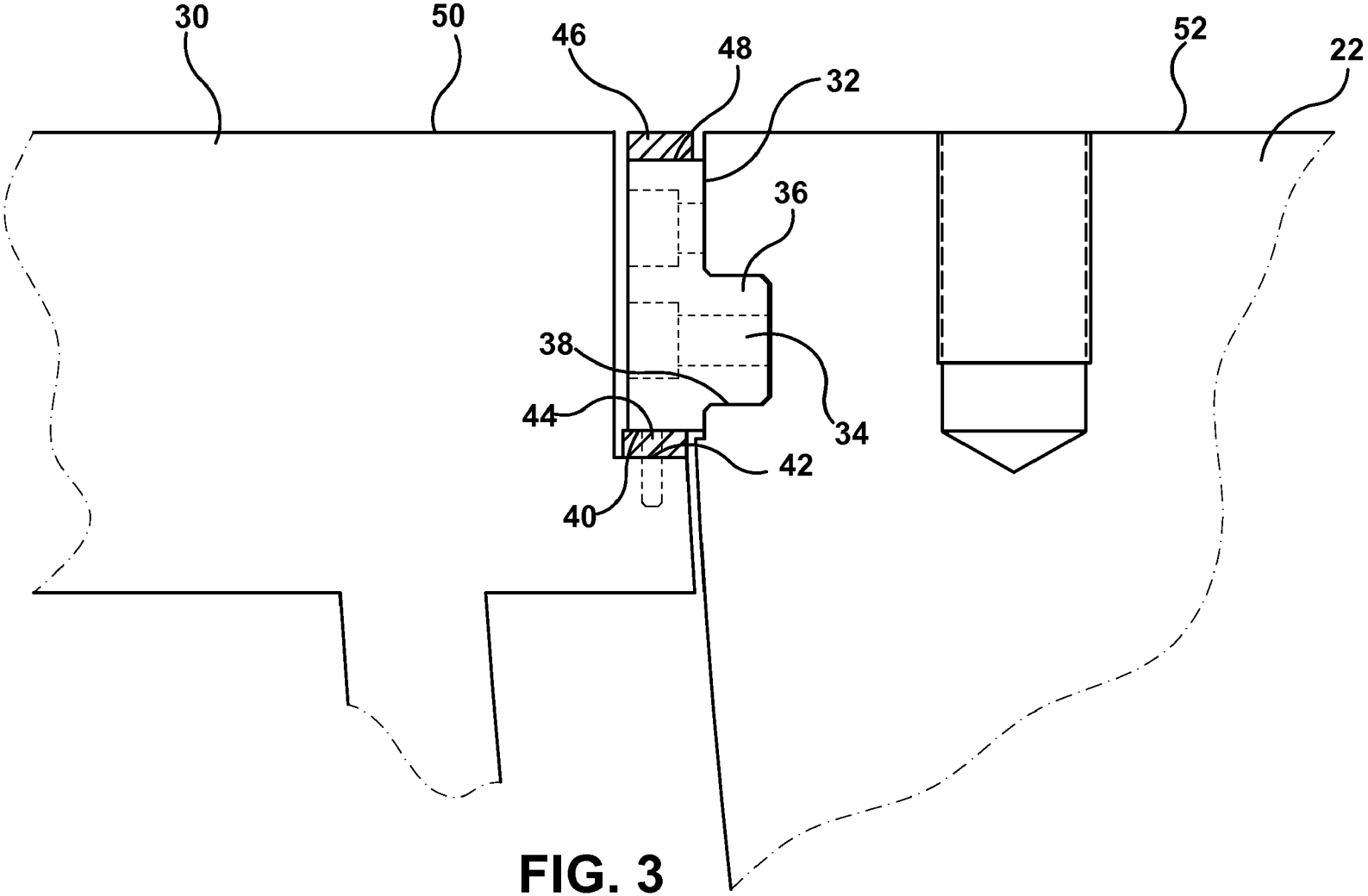
FIG. 3 (Prior Art)
FIG. 3 is a partial end elevation of a conventional diaphragm support bar attached to a lower diaphragm ring segment.

With reference now to FIG. 3, the lower diaphragm ring segment 22 is shown to be vertically supported within a turbine casing half (or simply, casing) 30 by a support bar 32 bolted to the diaphragm segment 22 by bolt(s) 34 extending through the support bar, and specifically through an inwardly directed flange 36 of the support bar that is received in a mating slot 38 in the lower diaphragm segment. The support bar otherwise extends vertically along the casing 30 on one side and the diaphragm segment 22 on the other side. The lower surface 40 of the support bar faces a shoulder 42 formed in the casing 30, with a shim block 44 interposed between the shoulder 42 and the lower surface 40 and typically bolted to the casing 30. A second shim block 46 is shown seated on the upper surface 48 of the support bar to effectively make the upper end of the support bar flush with the horizontal joint surfaces 50, 52 of the casing and diaphragm half, respectively, enabling the support bar 32 to be sandwiched between the upper and lower casing sections. The other side of the lower diaphragm segment 22 is similarly supported at the opposite side of the casing.

Figure 4:
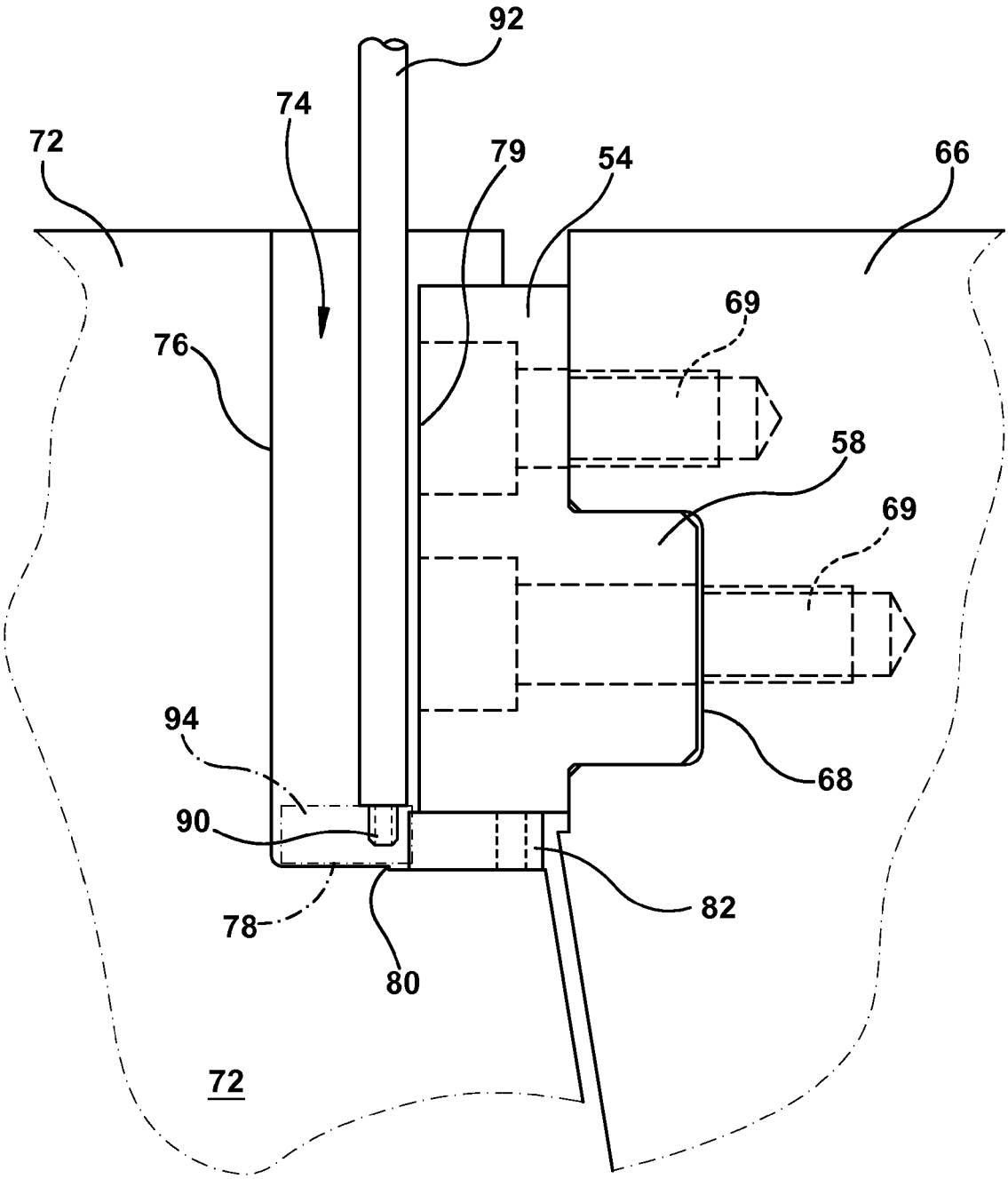
FIG. 4 is a partial end elevation of a support bar attached to a lower diaphragm segment in accordance with an exemplary embodiment of the invention.
Figure 5:
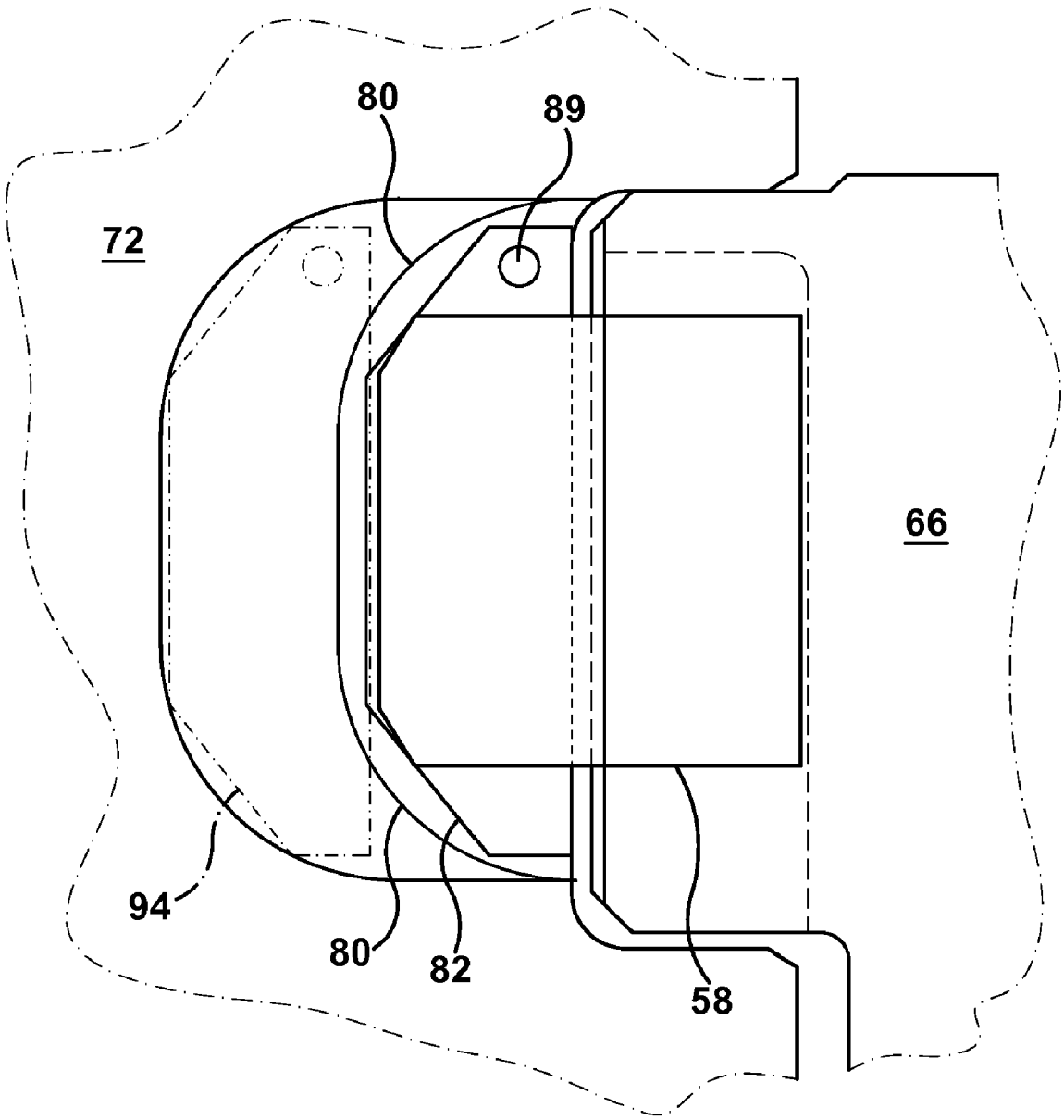
FIG. 5 is a partial plan view of the support bar illustrated in FIG. 4.

FIGS. 4 and 5 illustrate a newly designed support arrangement for a diaphragm segment in a turbine casing in accordance with an exemplary embodiment of this invention. A support bar 54 is formed with a flange 58. The lower diaphragm segment 66 is formed with an outwardly facing slot 68 that receives the flange 58. The support bar 54 is attached to the lower diaphragm segment 66 with bolts 69, which extend laterally through the support bar 54 and the flange 58 into the diaphragm segment 66.

A lower turbine casing or turbine casing 72 is formed with a cutout area 74 that includes a vertical wall 76 and a horizontal shoulder 78, a portion of which underlies the support bar 54. The cutout area 74, thus, is defined by the vertical wall 76 of the turbine casing 72 and an outer edge 79 of the support bar 54. In some embodiments, the shoulder 78 is formed with a shim retainment step 80 that is shaped to receive and at least partially enclose a shim 82. The shim 82 may be a single block. Thus, when the diaphragm segment 66 is located within the lower turbine casing 72, it is vertically supported by the bottom edge of the support bar 54 engaged indirectly with the casing shoulder 78, with the shim 82 interposed therebetween. It will be appreciated that a similar support bar is employed on the other side of the diaphragm segment, along the horizontal joint or split line.

FIG. 5 illustrates a plan view of the support bar 54. As shown, when installed, the sides of the shim 82 may extend beyond the edge of the support bar 54. In either of these sides, a removal hole 89 may be positioned. The removal hole 89 may be sized such that it may be engaged by a threaded insert 90 of a puller 92, as illustrated on FIG. 4.

With the above arrangement, adjustment of the vertical position of the diaphragm segment 66 in the lower casing 72 may be achieved with reduced downtime. It is only necessary to raise the lower diaphragm segment 66 an amount sufficient to allow removal of the shim 82 from the shim retainment step 80 so that the shim 82 can be removed and a differently-sized shim located in the shim retainment step 80. The removal of the shim 82 may be aided with the puller 92, which may be lowered through the cutout area 74. The threaded insert 90 of the puller 92 may engage the removal hole 89 of the shim 82 such that the shim 82 may be removed from underneath the support bar 54. Once the shim 82 is no longer beneath the support bar 54 (see a shim in removal position 94), the shim 82 may be removed vertically through the cutout area 74.

Thus, in use, the shim 82 may be removed and replaced as follows. First, the lower diaphragm segment 66 and the support bar 54 may be raised such that the lower surface of the support bar 54 no longer engages the shim 82. The lower diaphragm segment 66 and the support bar 54 may be further raised so that the shim 82 may clear the shim retainment step 80. Then, the puller 92 may be lowered through the cutout area 74 and positioned so that the threaded insert 90 engages the removal hole 89. Thus engaged, the puller 92 may be used to lift the shim 82 over the shim retainment step 80 and slide the shim 82 into the cutout area 74 (see the shim in removal position 94). The puller 82 then lifts the shim 82 through the cutout area 74 so that it may be removed. Once removed the shim 82 may be machined so that the proper vertical alignment of the lower diaphragm segment is achieved. The steps then may be reversed for the repositioning of the shim 82 under the support bar 54.

Figure 6:
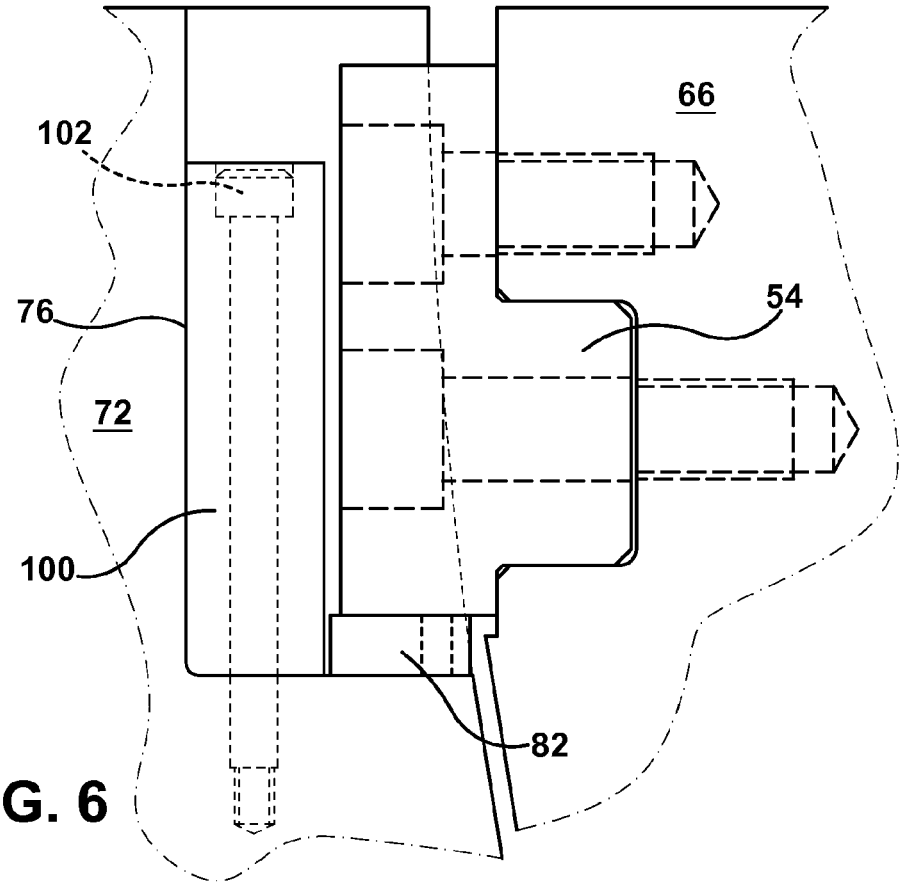
FIG. 6 is a partial end elevation of a support bar attached to a lower diaphragm segment in accordance with an alternative embodiment of the invention.
Figure 7:
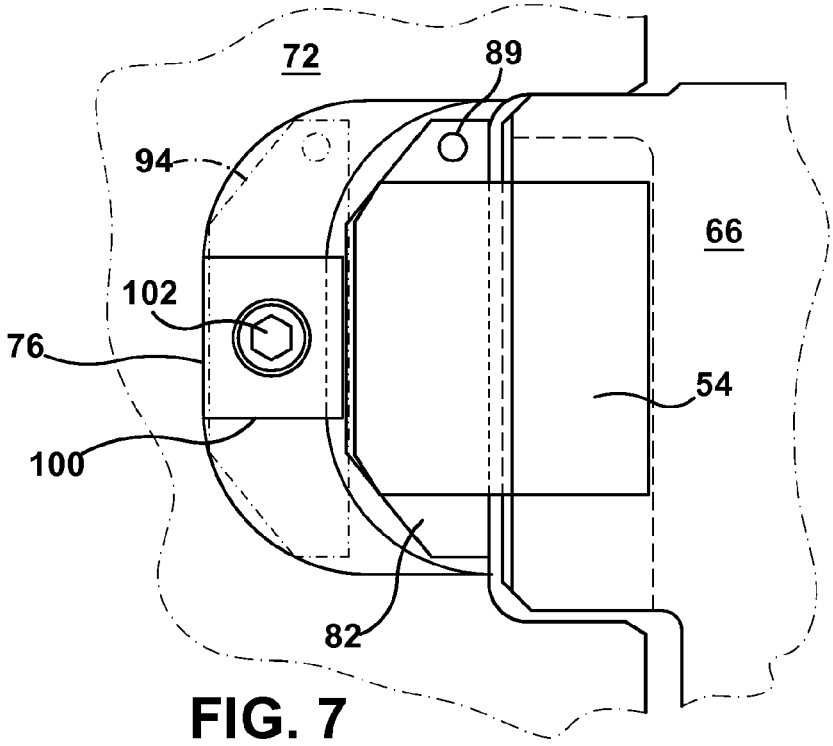
FIG. 7 is a partial plan view of the support bar illustrated in FIG. 6.

In an alternative embodiment, as illustrated in FIGS. 6 and 7, the shim 82 may be secured in place beneath the support bar 54 by a back block 100. The back block 100 may include a solid block that is positioned in the cutout area 74 such that it prevents the shim 82 from moving into the cutout area 74 during operation. As shown, the back block 100 may be a rectangular block that, once installed in the cutout area 74, generally abuts the shim 82 and the vertical wall 76 of the turbine casing 72. The back block 100 may be held into place by a bolt 102. In some embodiments, the height of the back block 100 may be approximately the same as the shim 82. In other embodiments, as shown, the vertical height of the back block 100 may be much greater so that it has approximately the same vertical height as the support bar 54. In such an arrangement, more efficient access to the bolt 102 may be achieved, which may allow the bolt 102 to be efficiently staked during installation.

With back block 100 holding the shim 82 in place, the shim retainment step 80 may be unnecessary. Thus, in use, the shim 82 may be removed and replaced as follows. First, the lower diaphragm segment 66 and the support bar 54 may be raised such that the lower surface of the support bar 54 no longer engages the shim 82. Because there is no shim retainment step 80, further raising of the lower diaphragm segment 66 and the support bar 54 is unnecessary. The bolt 102 may be disengaged and the back block 100 removed. Then, the puller 90 may be lowered through the cutout area 74 and positioned so that the threaded insert 92 engages the removal hole 89. Thus engaged, the puller may be used to slide the shim 82 into the cutout area 74 (see the shim in removal position 94) and then to remove the shim 82 through the cutout area 74. Once removed, the shim 82 may be machined so that the proper vertical alignment of the lower diaphragm segment is achieved. The steps then may be reversed for the repositioning of the shim 82 under the support bar 54.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A support arrangement for a diaphragm segment in a turbine casing comprising:

a support bar joined to a diaphragm segment;

a turbine casing comprising a vertical wall and a horizontal shoulder, wherein a portion of the horizontal shoulder underlies the support bar;

a cut out area defined by the vertical wall and an outer edge of the support bar;

means for retaining the shim between the horizontal shoulder and the support bar; and a shim interposed between the horizontal shoulder and the support bar;

wherein the cut out area comprises a width that is at least greater than a width of the shim such that the shim may pass widthwise therethrough; and wherein the means for retaining the shim between the horizontal shoulder and the support bar comprises a back block positioned in the cutout area.

2. The support arrangement of claim 1, wherein the support bar includes a flange that engages an outwardly facing slot in the diaphragm segment.

3. The support arrangement of claim 2, wherein one or more bolts extend through the flange and into the diaphragm segment.

4. The support arrangement of claim 1, wherein the back block is positioned between the shim and the vertical wall and abuts the shim and the vertical wall of the turbine casing.

5. The support arrangement of claim 1, wherein the back block is secured to the turbine casing by a bolt that passes through the back block into the horizontal shoulder.

6. The support arrangement of claim 1, wherein the height of the back block is approximately the same as the height of the shim.

7. The support arrangement of claim 1, wherein the height of the back block is approximately the same as the height of the support bar.

8. The support arrangement of claim 1, wherein the shim includes a removal hole.

9. The support arrangement of claim 8, further comprising a puller with a threaded insert that may engage the removal hole.

10. The support arrangement of claim 8, wherein at least one of the sides of the shim extends beyond an edge of the support bar; and wherein the removal hole is positioned within a portion of the shim that extends beyond the edge of the support bar.

11. A turbine, comprising:

a diaphragm that includes a lower diaphragm segment and an upper diaphragm segment that join at a horizontal split;

a support bar that attaches to the lower diaphragm segment;

a turbine casing that includes a vertical wall and a horizontal shoulder, wherein a portion of the horizontal shoulder underlies the support bar;

a cut out area defined by the vertical wall and an outer edge of the support bar; and means for retaining the shim between the horizontal shoulder and the support bar; and a shim interposed between the horizontal shoulder and the support bar;

wherein the cut out area comprises a width that is at least greater than a width of the shim such that the shim may pass widthwise therethrough; and wherein the means for retaining the shim between the horizontal shoulder and the support bar comprises a back block positioned in the cutout area.

12. The turbine of claim 11, wherein at least one of the sides of the shim extends beyond an edge of the support bar; and wherein the shim further comprises a removal hole that is positioned within a portion of the shim that extends beyond the edge of the support bar.

13. The turbine of claim 12, further comprising a puller with a threaded insert that may engage the removal hole.

14. The turbine of claim 11, further comprising a shim retainment step in the horizontal shoulder, the shim retainment step including a step that at least partially encloses the shim when the shim is positioned between the horizontal shoulder and the support bar.

15. The turbine of claim 11, wherein the back block is secured to the turbine casing by a bolt that passes through the back block into the horizontal shoulder.

16. The turbine of claim 11, wherein the support bar includes a flange that engages an outwardly facing slot in the lower diaphragm segment.

* * * * *